US011217930B2

(12) United States Patent
Wakimoto

(10) Patent No.: US 11,217,930 B2
(45) Date of Patent: Jan. 4, 2022

(54) SEAL COVER

(71) Applicant: Sumitomo Wiring Systems, Ltd., Mie (JP)

(72) Inventor: Isao Wakimoto, Mie (JP)

(73) Assignee: Sumitomo Wiring Systems, Ltd.

( * ) Notice: Subject to any disclaimer, the term of this patent is extended or adjusted under 35 U.S.C. 154(b) by 912 days.

(21) Appl. No.: 15/774,379

(22) PCT Filed: Oct. 20, 2016

(86) PCT No.: PCT/JP2016/081051
§ 371 (c)(1),
(2) Date: May 8, 2018

(87) PCT Pub. No.: WO2017/082008
PCT Pub. Date: May 18, 2017

(65) Prior Publication Data

US 2020/0251850 A1 Aug. 6, 2020

(30) Foreign Application Priority Data

Nov. 10, 2015 (JP) ..... JP2015-220572

(51) Int. Cl.
*H01R 13/52* (2006.01)
*H01R 13/516* (2006.01)
(Continued)

(52) U.S. Cl.
CPC ..... *H01R 13/5202* (2013.01); *H01R 13/516* (2013.01); *H01R 13/5213* (2013.01); *H01R 13/631* (2013.01); *H01R 13/701* (2013.01)

(58) Field of Classification Search
CPC ..... H01R 13/5202; H01R 13/5205; H01R 13/5221; H01R 13/5213; H01R 13/5216;
(Continued)

(56) References Cited

U.S. PATENT DOCUMENTS 8,610,005 B2 * 12/2013 Iida ..... H05K 5/0069 174/520
8,908,380 B2 * 12/2014 Ohhashi ..... H05K 5/0052 361/752
(Continued)

FOREIGN PATENT DOCUMENTS

JP 10-302885 11/1998
JP 2010-182584 8/2010
(Continued)

OTHER PUBLICATIONS

International Search Report dated Jan. 17, 2017.

*Primary Examiner* — Angel R Estrada
(74) *Attorney, Agent, or Firm* — Gerald E. Hespos; Michael J. Porco; Matthew T. Hespos

(57) ABSTRACT

A seal cover (1) is provided for closing an opening portion (10) in a device in which a standby connector (11) is disposed. The standby connector (11) includes male terminals 11B for switching a state of an energizing circuit between a conductive state and a non-conductive state. Female terminals (23B), a shaft seal (25) and an O-ring (23D) are arranged in such a positional relationship that a time point when the shaft seal (25) is compressed maximally, a time point when the O-ring (23D) is compressed maximally and a time point when the female terminals (23B) are resiliently deformed maximally do not overlap with each other when the seal cover (1) is mounted on the opening portion (10).

2 Claims, 10 Drawing Sheets

(51) Int. Cl.
*H01R 13/631* (2006.01)
*H01R 13/70* (2006.01)

(58) Field of Classification Search
CPC ..... H01R 13/5219; H01R 13/631; H01R 13/701; H01R 13/521; H01R 13/6581; H01R 2201/26; H01R 13/748; H01R 13/74; H01R 13/516; B60R 16/02; B60R 16/0239; B60R 16/0238; H05K 5/00; H05K 5/02; H05K 9/0018; H02G 3/08; H02G 3/081; H02G 3/088; H02G 3/14
USPC ..... 174/50, 520, 539, 554, 559, 564, 77 R, 174/137 R, 176, 17 CT, 138 R; 16/2.1, 16/2.2; 439/521, 519, 535, 76.1, 76.2; 361/600, 601, 641, 669
See application file for complete search history.

(56) References Cited

U.S. PATENT DOCUMENTS

| | | | | |
|---|---|---|---|---|
| 10,158,192 | B1 * | 12/2018 | Yokotani | H01R 13/5845 |
| 10,218,110 | B2 * | 2/2019 | Wakimoto | H01R 13/5202 |
| 10,355,430 | B2 * | 7/2019 | Yokotani | H01R 13/5213 |
| 10,873,150 | B2 * | 12/2020 | Miyazawa | H01R 13/42 |
| 11,011,868 | B2 * | 5/2021 | Miyamoto | H01R 13/5202 |
| 2012/0285718 | A1 | 11/2012 | Sakakura | |

FOREIGN PATENT DOCUMENTS

| | | |
|---|---|---|
| JP | 2012-238422 | 12/2012 |
| JP | 2012-248415 | 12/2012 |

* cited by examiner

SEAL COVER

BACKGROUND

Field of the Invention

This specification relates to a seal cover for closing an opening portion provided in a device.

Description of the Related Art

Japanese Unexamined Patent Publication No. 2012-238422 discloses a seal cover that closes an opening in a device. Specifically, the seal cover described in Japanese Unexamined Patent Publication No. 2012-238422 includes a cover body to be mounted on a surface of a case (device) and a ring holding portion disposed to fit into an opening on a back surface side of the cover body. A seal ring is fit on an outer peripheral surface of the ring holding portion and closely contacts the inner peripheral surface of the opening. The seal ring is compressed and held in close contact with the inner peripheral surface of the opening when the ring holding portion is fit into the opening so that water, foreign matter and the like cannot penetrate through the opening.

Japanese Unexamined Patent Publication No. 2012-238422 also discloses a standby connector having a switch functioning portion for switching a state of an energizing circuit between a conductive state and a non-conductive state. An interlock connector is provided in the ring holding portion of the seal cover, and the energizing circuit is brought into the conductive state or the non-conductive state as the interlock connector is connected to or separated from the standby connector.

Japanese Unexamined Patent Publication No. 2012-238422 discloses a known connector to be connected to a mating connector and configured so that one of a terminal of the connector and a terminal of the mating connector is deformed resiliently to be pressed into contact with the other terminal. Specifically, the connector described in Japanese Unexamined Patent Publication No. 2012-238422 has an inverter-side terminal pressed by a motor-side terminal to be deformed resiliently and is pressed into contact with the motor-side terminal in a resiliently deformed state.

The seal cover described in Japanese Unexamined Patent Publication No. 2012-238422 does not have a ring made of resin such as an O-ring fit on the outer peripheral surface of the interlock connector. However, if a ring made of resin is fit on the out peripheral surface of the interlock connector and brought into contact with the inner peripheral surface of the standby connector while being compressed, the rattling of the interlock connector with respect to the standby connector can be suppressed more reliably.

However, in the case of a seal cover to be brought into close contact with the inner peripheral surface of the standby connector with a seal ring fit on a fitting portion compressed or configured to resiliently deform the terminal of the interlock connector and the terminal of the mating connector and press the terminals into contact, if the aforementioned ring made of resin is fit on the interlock connector, a worker needs a large force when mounting the seal cover on the opening portion, depending on a positional relationship of the ring made of resin, the seal ring and the terminal of the interlock connector, and a burden of the worker may increase.

This specification discloses a seal cover that reduces a burden of a worker when mounting a seal cover with an interlock connector having a ring made of resin fit on an outer peripheral surface.

SUMMARY

This specification relates to a seal cover for closing an opening portion in a device. A standby connector is provided in the device and includes a standby terminal for switching a state of an energizing circuit between a conductive state and a non-conductive state. The seal cover includes a lid for covering an opening of the opening portion. A fitting is disposed on a back surface of the lid and is configured to fit into the opening portion. A first ring made of resin is fit on an outer peripheral surface of the fitting and is to be compressed and held in close contact with an inner peripheral surface of the opening portion. An interlock connector projects from the fitting and is connectable to the standby connector. The interlock connector includes a detection terminal to be pressed into contact with the standby terminal. A second ring made of resin is fit on an outer peripheral surface of the interlock connector and is to be compressed and held in close contact with an inner peripheral surface of the standby connector. One of the standby terminal and the detection terminal is deformed resiliently and pressed into contact with the other terminal. The detection terminal, the first ring and the second ring are arranged in such a positional relationship that a time point when the first ring is compressed maximally, a time point when the second ring is compressed maximally and a time point when the one terminal is resiliently deformed maximally do not overlap with each other when the seal cover is mounted on the opening portion.

The first ring is compressed by a force of a worker pushing the seal cover into the opening portion. When the first ring is viewed singly, the force of the worker pushing the seal cover is maximized when the first ring is maximally compressed. The same applies also to the second ring and the one terminal.

Thus, if at least two time points, out of the three time points, i.e. the time point when the first ring is compressed maximally, the time point when the second ring is compressed maximally and the time point when the one terminal is resiliently deformed maximally, overlap, a large force is necessary when the worker pushes the seal cover as compared to the case where those three time points do not overlap each other.

Accordingly, the force required when the worker pushes the seal cover can be reduced since the three time points described above do not overlap each other. In this way, a burden on the worker when mounting the seal cover with the interlock connector having the ring (second ring) made of resin fit on the outer peripheral surface can be reduced.

An annular step may protrude over an entire circumference and may have the second ring fit thereon. A rib may be formed on the outer peripheral surface of the interlock connector and may be provided in front of the step in a connecting direction. The rib may be pressed into contact with the inner peripheral surface of the standby connector and squeezed when the interlock connector is connected to the standby connector. The detection terminal, the first ring, the second ring and the rib may be arranged in such a positional relationship that the time point when the first ring is compressed maximally, the time point when the second ring is compressed maximally, the time point when the one terminal is resiliently deformed maximally and a time point when the squeezing of the rib is finished do not overlap with each other when the seal cover is mounted on the opening portion. Thus, the burden of the worker can be reduced further since the four time points described above do not overlap with each other.

According to the invention, it is possible to reduce a burden of a worker in mounting a seal cover with an interlock connector having a ring made of resin fit on an outer peripheral surface.

DETAILED DESCRIPTION

An embodiment is described with reference to FIGS. 1 to 10. In the following description, a front-rear direction and a lateral direction are based on a front-rear direction and a lateral direction shown in FIG. 1, and a vertical direction is based on a vertical direction shown in FIG. 3.

Figure 1:
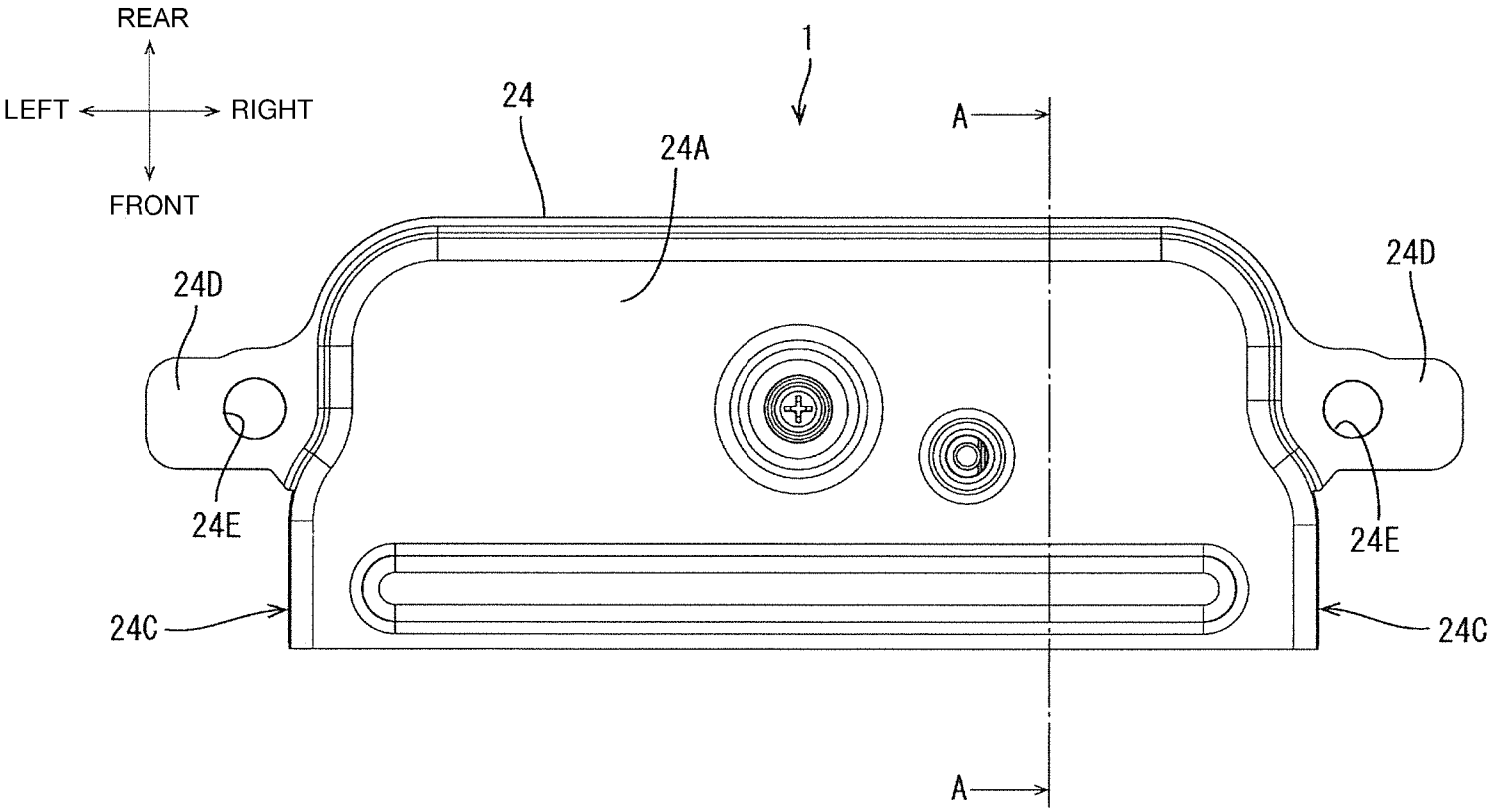
FIG. 1 is a top view of a seal cover according to an embodiment.

First, an outline of a seal cover 1 according to this embodiment is described with reference to FIG. 1. The seal cover 1 is for closing an annular opening portion 10 (see FIGS. 2 and 3) provided in a case (an example of a device) accommodating an inverter installed in a vehicle, such as an electric or hybrid vehicle.

(1) Opening Portion and Standby Connector

Figure 2:
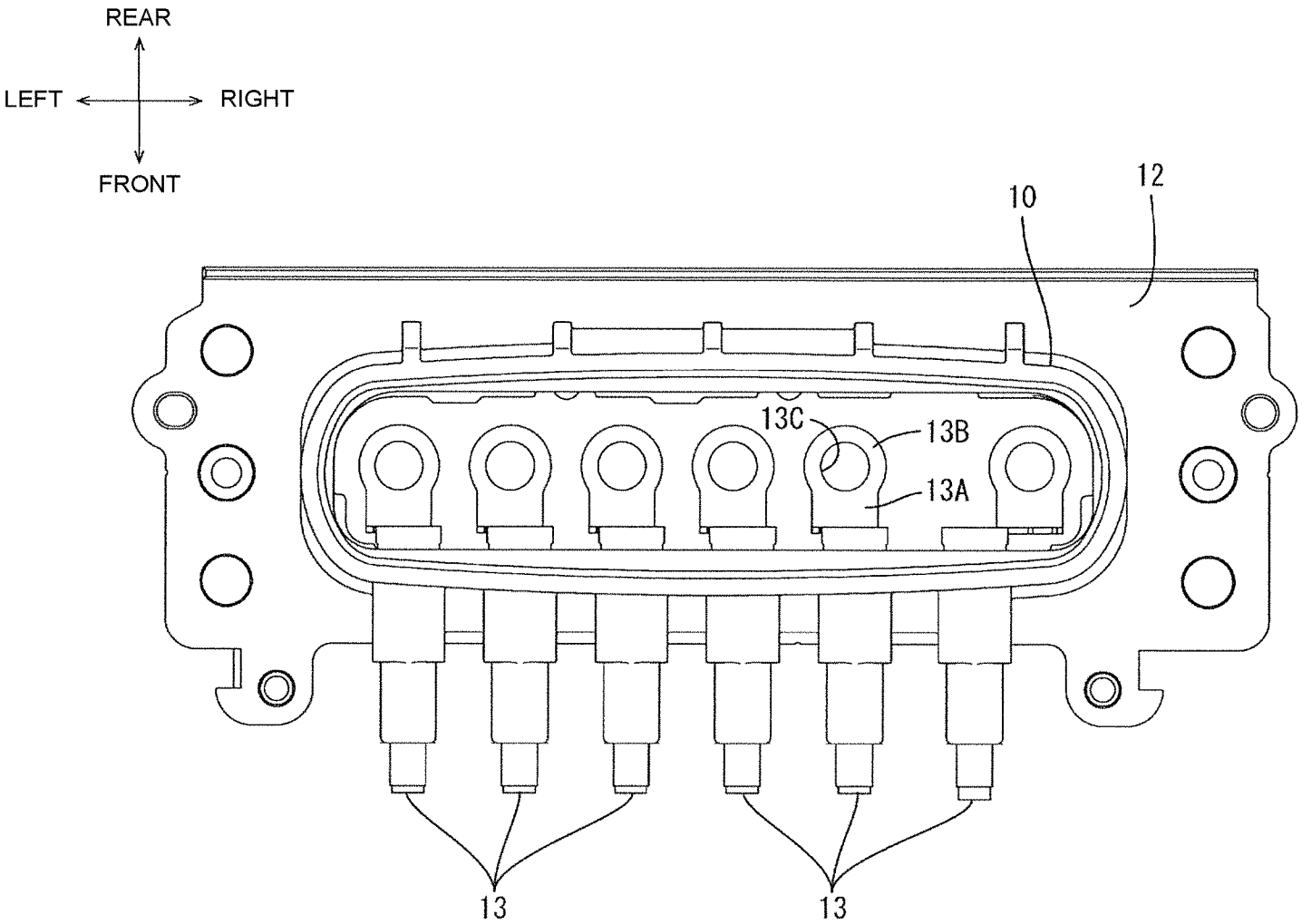
FIG. 2 is a top view of an opening portion provided in a device.
Figure 3:
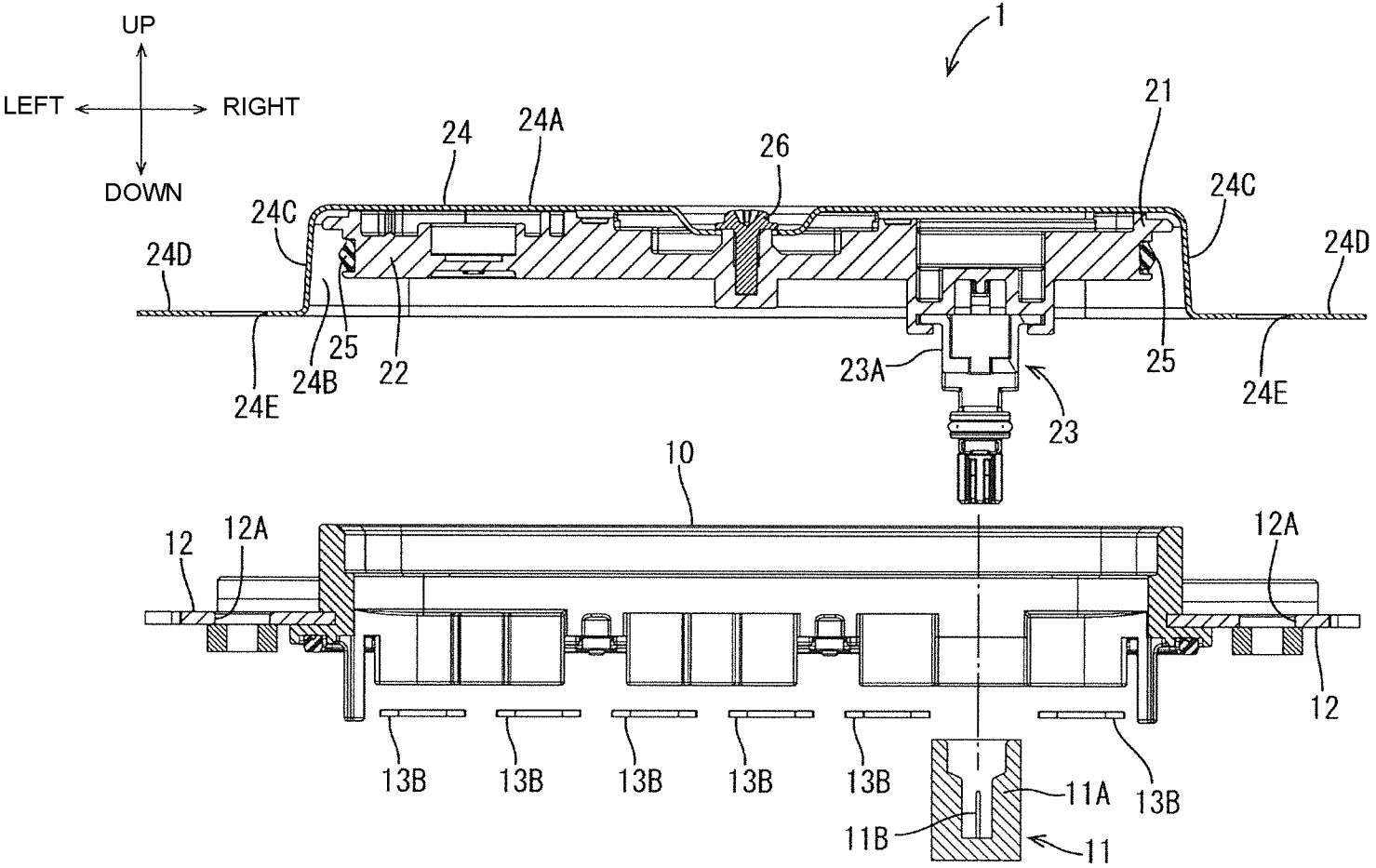
FIG. 3 is a section of the seal cover, the opening portion and a standby connector.

The aforementioned annular opening portion 10 and a standby connector 11 disposed in the case are described with reference to FIGS. 2 and 3. The opening portion 10 is made of resin and is formed into a substantially elliptical shape in a top view, as shown in FIG. 2. As shown in FIG. 3, the opening portion 10 is open on both upper and lower sides and a metal plate 12 protruding from an outer periphery is integrated by insert molding.

An opening is provided in the case of the unillustrated inverter, and the opening portion 10 is mounted on the case by the metal plate 12 being fixed to the case by bolts with a lower part thereof inserted in the opening of the case. Unillustrated terminal bolts project up on the case of the inverter. When the opening portion 10 is mounted on the case, those terminal bolts project into the inside of the opening portion 10 through the lower opening of the opening portion 10.

As shown in FIG. 2, wires 13 are held in the opening portion 10 while penetrating through an annular wall constituting the opening portion 10 in the front-rear direction. Each wire 13 has a terminal fitting 13A connected to a core of a tip part thereof and the other end part thereof is connected to an unillustrated three-phase motor.

The terminal fitting 13A includes a contact portion 13B in the form of a substantially circular plate, and a through hole 13C penetrates the contact portion 13B in a plate thickness direction. The contact portion 13B is fixed to the aforementioned terminal bolt by inserting the terminal bolt into the through hole 13C and threadably engaging a nut with the terminal bolt in that state.

As shown in FIG. 3, the inner peripheral surface of the opening portion 10 is recessed over the entire circumference. An inner peripheral shape of an upper part substantially matches an outer peripheral shape of a later-described fitting 22 of the seal cover 1.

The standby connector 11 of an interlocking mechanism is disposed below the opening in the case of the inverter. The standby connector 11 includes a receptacle-like standby housing 11A in the form of a bottomed tube that opens forward (up in FIG. 3) in a connecting direction, and two male terminals 11B (an example of a standby terminal) project forward in the connecting direction from a bottom wall of the standby housing 11A. Note that since the two male terminals 11B are disposed side by side in a direction perpendicular to the plane of FIG. 3, only one male terminal 11B is visible in FIG. 3.

The standby housing 11A is formed such that an inner diameter of a rear side (lower side in FIG. 3) in the connecting direction is smaller than an inner diameter of a front side (upper side in FIG. 3) in the connecting direction. An inner peripheral shape of the rear side of the standby housing 11A in the connecting direction substantially matches an outer peripheral shape of a tip part of a connector housing 23A (see FIG. 4) of a later-described interlock connector 23, and an inner peripheral shape of the front side in the connecting direction substantially matches an outer peripheral shape of a step 23C (see FIG. 4) on the outer peripheral surface of the tip part of the connector housing 23A.

The two male terminals 11B are for switching a state of an energizing circuit between a conductive state and a non-conductive state. The energizing circuit is for electrically connecting the inverter and the three-phase motor via the terminal fittings 13A and the terminal bolts. When the later-described interlock connector 23 is fit and inserted into the standby connector 11, the two male terminals 11B are connected electrically to each other so that the energizing circuit is brought into the conductive state. When the interlock connector 23 is separated from the standby connector 11, the two male terminals 11B are electrically cut off from each other so that the energizing circuit is brought into the non-conductive state.

(2) Configuration of Seal Cover

Next, the configuration of the seal cover 1 is described with reference to FIGS. 3 and 4. As shown in FIG. 3, the seal cover 1 includes a lid 21, the fitting 22, the interlock connector 23 and a shield case 24.

The lid 21 is made of resin and is configured for closing the opening portion 10 from above. The lid 21 has a shape substantially matching an outer peripheral shape of the opening portion 10 when viewed from above.

The fitting 22 is on a back surface side of the lid 21 and is disposed to fit into the opening portion 10. The outer peripheral surface of the fitting 22 is recessed over the entire circumference, thereby forming a recess, and a shaft seal 25 (an example of a first ring) made of resin is fit into this recess. When the fitting 22 is fit into the opening portion 10, the shaft seal 25 is compressed and held in close contact with the inner peripheral surface of an upper part of the opening portion 10, thereby sealing between the fitting 22 and the opening portion 10 in a watertight manner.

Figure 4:
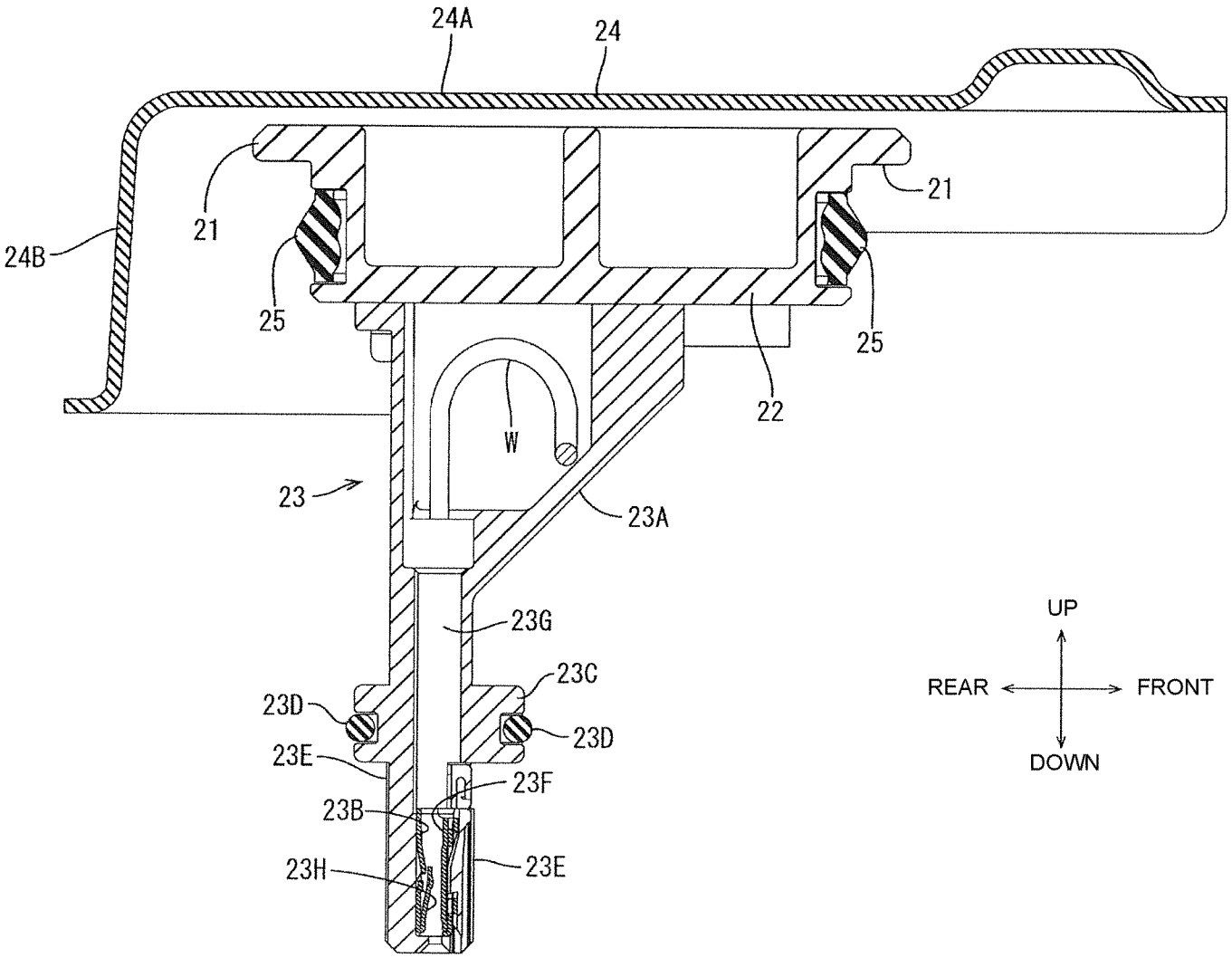
FIG. 4 is a section along A-A in FIG. 1 of the seal cover.

As shown in FIG. 4, the interlock connector 23 projects down from the fitting 22 and is held on the fitting 22 in a floating state to be displaceable in a direction perpendicular to the connecting direction (vertical direction in FIG. 4). The interlock connector 23 includes the connector housing 23A made of synthetic resin, two female terminals 23B (examples of a detection terminal and a first terminal) accommodated in the connector housing 23A and a coated wire W connecting the female terminals 23B.

The tip part of the connector housing 23A is fit and inserted into the standby housing 11A of the standby connector 11. The annular step 23C protruding over the entire circumference is formed on the outer peripheral surface of the tip part of the connector housing 23A to be fit into the standby housing 11A.

The outer peripheral surface of the step 23C is recessed over the entire circumference, thereby forming a recess. An O-ring 23D (an example of a second ring) made of resin is fit into that recess. When the connector housing 23A is fit into the standby housing 11A, the O-ring 23D is compressed and held in close contact with the inner peripheral surface of the standby housing 11A to suppress rattling of the interlock connector 23 with respect to the standby connector 11.

Further, two opposed ribs 23E project on a side of the outer peripheral surface of the connector housing 23A before the step 23C in the connecting direction and extend in the connecting direction. The ribs 23E are pressed into contact with the inner peripheral surface of the standby housing 11A to be squeezed when the connector housing 23A is fit and inserted into the standby connector 11. In this way, the rattling of the interlock connector 23 with respect to the standby connector 11 is suppressed more.

The coated wire W is configured such that a core is coated with an insulation coating and the insulation coating is stripped on both ends to expose the core.

Each of the female terminals 23B includes a connecting tube 23F connectable to the male terminal 11B held in the standby connector 11A and a crimping portion 23G integrally formed to the connecting tube 23F behind the connecting tube 23F.

The connecting tube 23F is in the form of a rectangular tube open forward and rearward, and the male terminal 11B of the standby housing 11A is inserted through a front end opening of the connecting tube 23F. When the male terminal 11B is inserted into the connecting tube 23F, a resilient contact piece 23H provided in the connecting tube 23F is pressed by the male terminal 11B to be deformed resiliently and pressed into contact with the male terminal 11B in a resiliently deformed state. In this way, the male terminal 11B and the female terminal 23B are connected electrically.

The crimping portion 23G is crimped to the core exposed at the end of the coated wire W. The two female terminals 23B are connected to one another by crimping the crimping portions 23G of the two female terminals 23B to the ends of one coated wire W, the. In this way, when the interlock connector 23 is fit and inserted into the standby connector 11, the two male terminals 11B of the standby connector 11 are electrically connected via the pair of female terminals 23B and the coated wire W so that the energizing circuit is brought into the conductive state.

As shown in FIG. 3, the shield case 24 is formed into a hexahedron shape having an upper wall 24A substantially parallel to the metal plate 12, a rear wall 24B connected to the upper wall 24A and two side walls 24C provided on both left and right sides across the rear wall 24B, and fastened to the lid 21 of the seal cover 1 by inserting a bolt 26 through a bolt insertion hole formed in the upper wall 24A.

Mounting plates 24D protruding substantially parallel to the metal plate 12 of the opening portion 10 are formed integrally on the both left and right sides of the shield case 24. Each mounting plate 24D is formed with a bolt insertion hole 24E penetrating in a plate thickness direction. The shield case 24 is fastened to the case by inserting unillustrated bolts through the bolt insertion holes 24E of the shield case 24 and bolt insertion holes 12A of the metal plate 12. In this way, the seal cover 1 cannot detach, and a shield path between the shield case 24 and the case of the inverter is ensured.

(3) Positional Relationship of Ribs, Female Terminals, O-ring and Shaft Seal A state of mounting the seal cover 1 on the opening portion 10 is described in a chronological order with reference to FIGS. 5 to 9.

Figure 5:
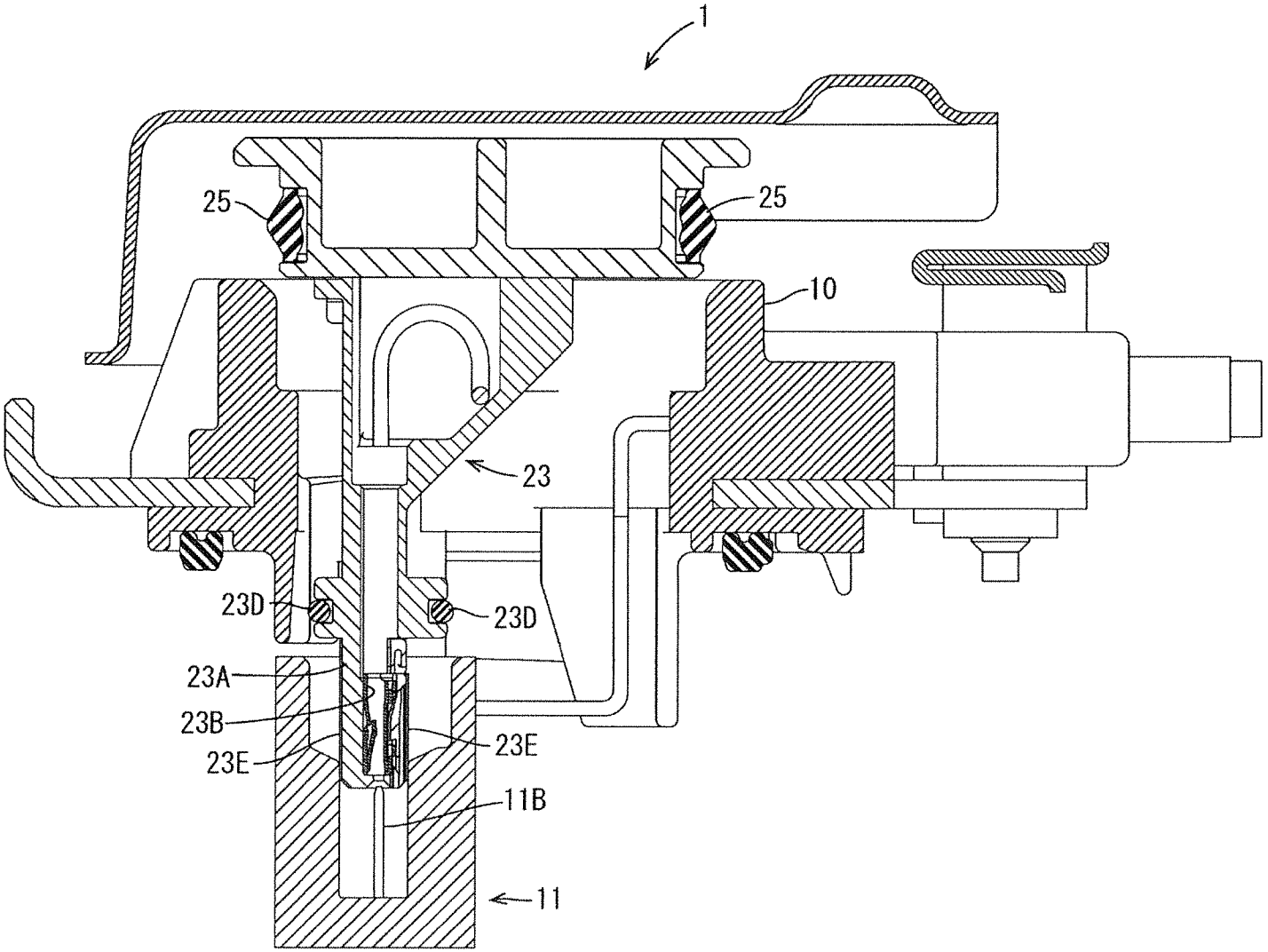
FIG. 5 is a section showing a state of mounting the seal cover.

As shown in FIG. 5, when the seal cover 1 is pushed by a worker, the tip part of the connector housing 23A of the interlock connector 23 initially is fit and inserted into the standby connector 11 and the ribs 23E are pressed into contact with the inner peripheral surface of the standby connector 11, thereby starting to be squeezed. Note that a force for squeezing the ribs 23E is maximized when the squeezing of the ribs 23E is finished, and the force for squeezing the ribs 23E has not reached its maximum at a time point shown in FIG. 5.

Figure 6:
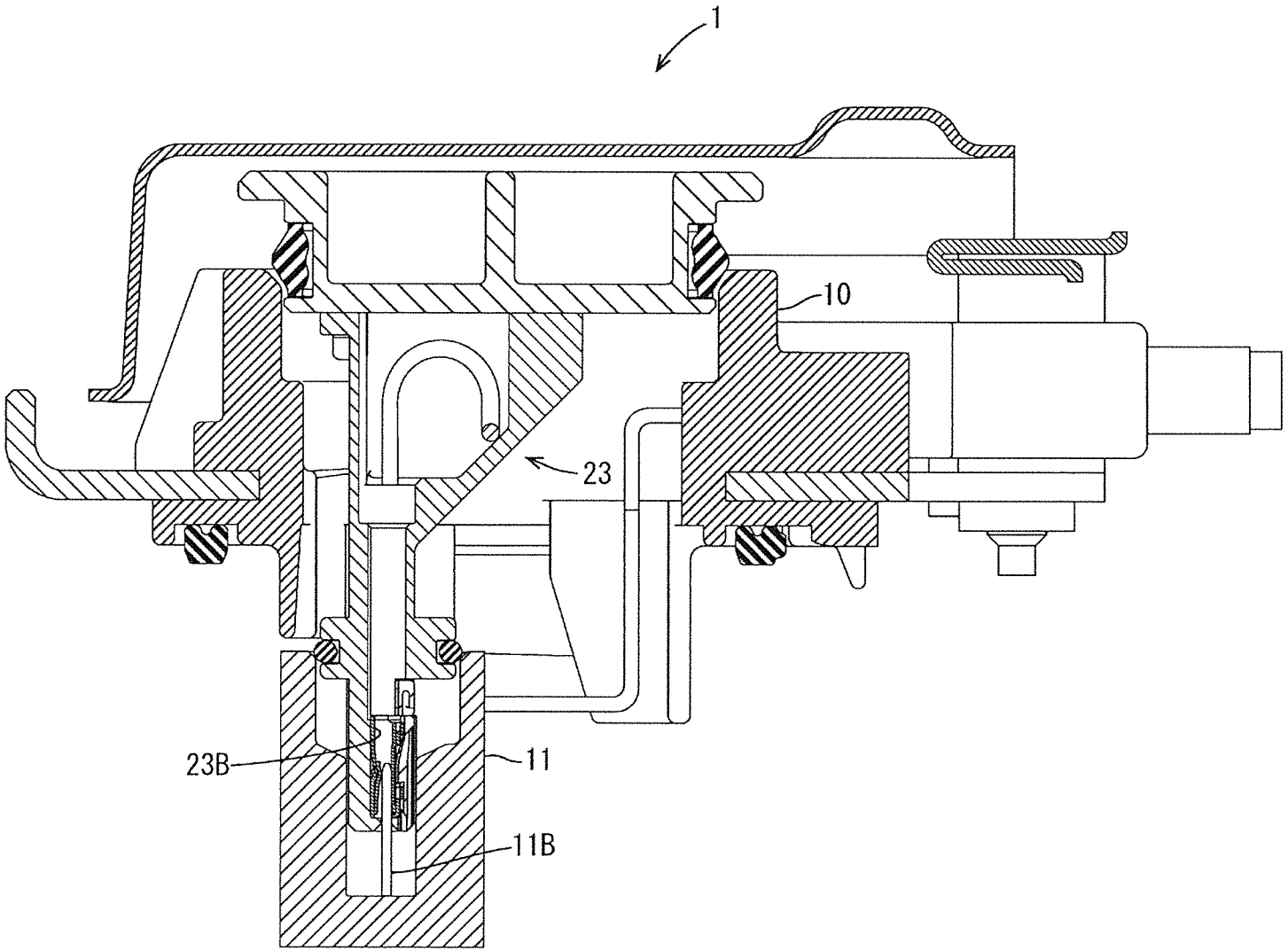
FIG. 6 is a section showing the state of mounting the seal cover.

When the seal cover 1 is pushed farther, as shown in FIG. 6, the female terminals 23B of the interlock connector 23 contact the male terminals 11B of the standby connector 11 and resiliently deformed by being pressed by the male terminals 11B. FIG. 6 shows a state at a time point when the female terminals 23B are resiliently deformed maximally, and this time point is referred to as a time point T1 in the following description.

Figure 7:
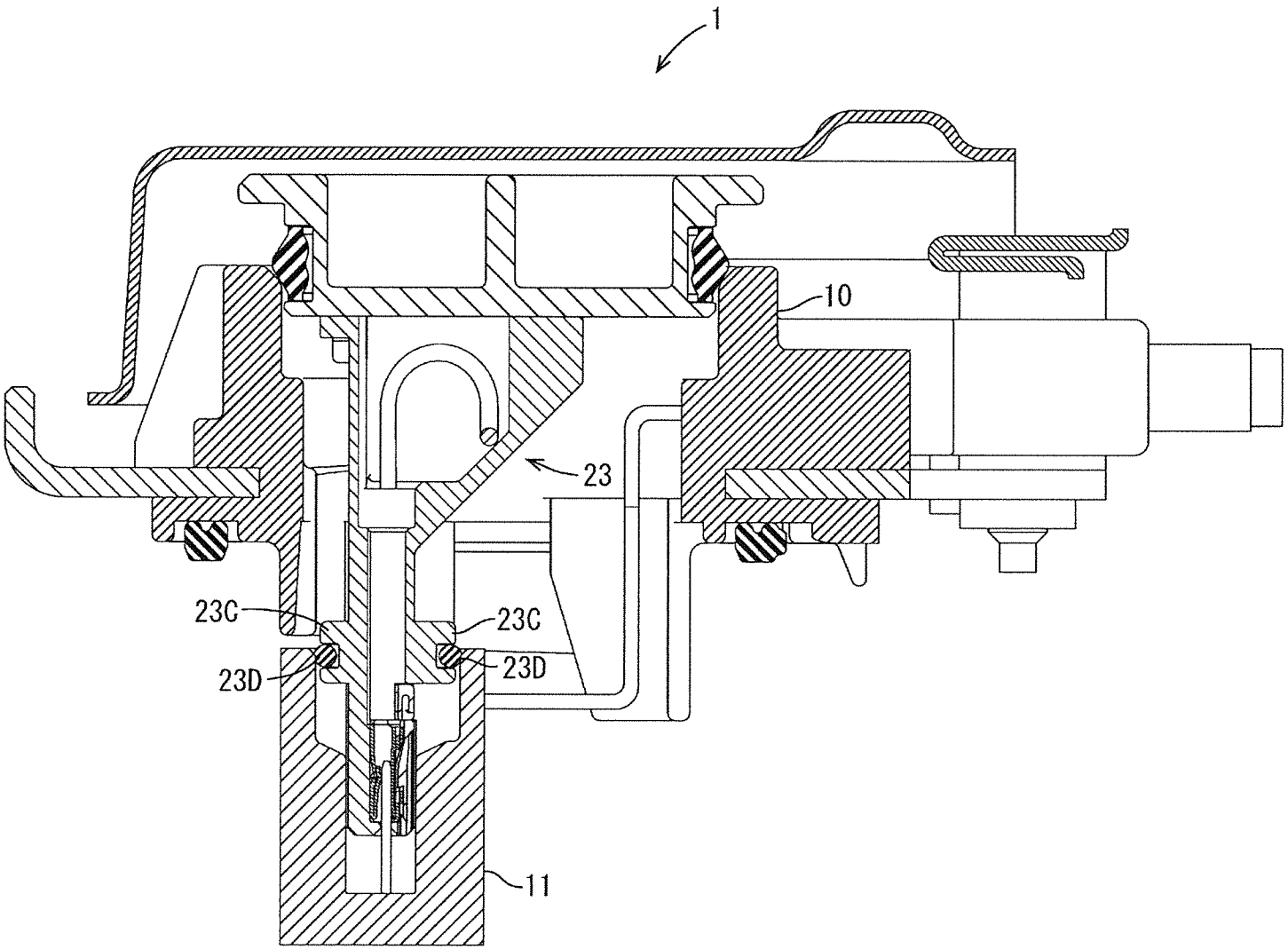
FIG. 7 is a section showing the state of mounting the seal cover.

When the seal cover 1 is pushed farther, as shown in FIG. 7, the step 23C of the interlock connector 23 is fit into the standby connector 11, and the O-ring 23D is pressed by the inner peripheral surface of the standby connector 11 to be compressed. FIG. 7 shows a state at a time point when the O-ring 23D is compressed maximally, and this time point is referred to as a time point T2 in the following description.

Figure 8:
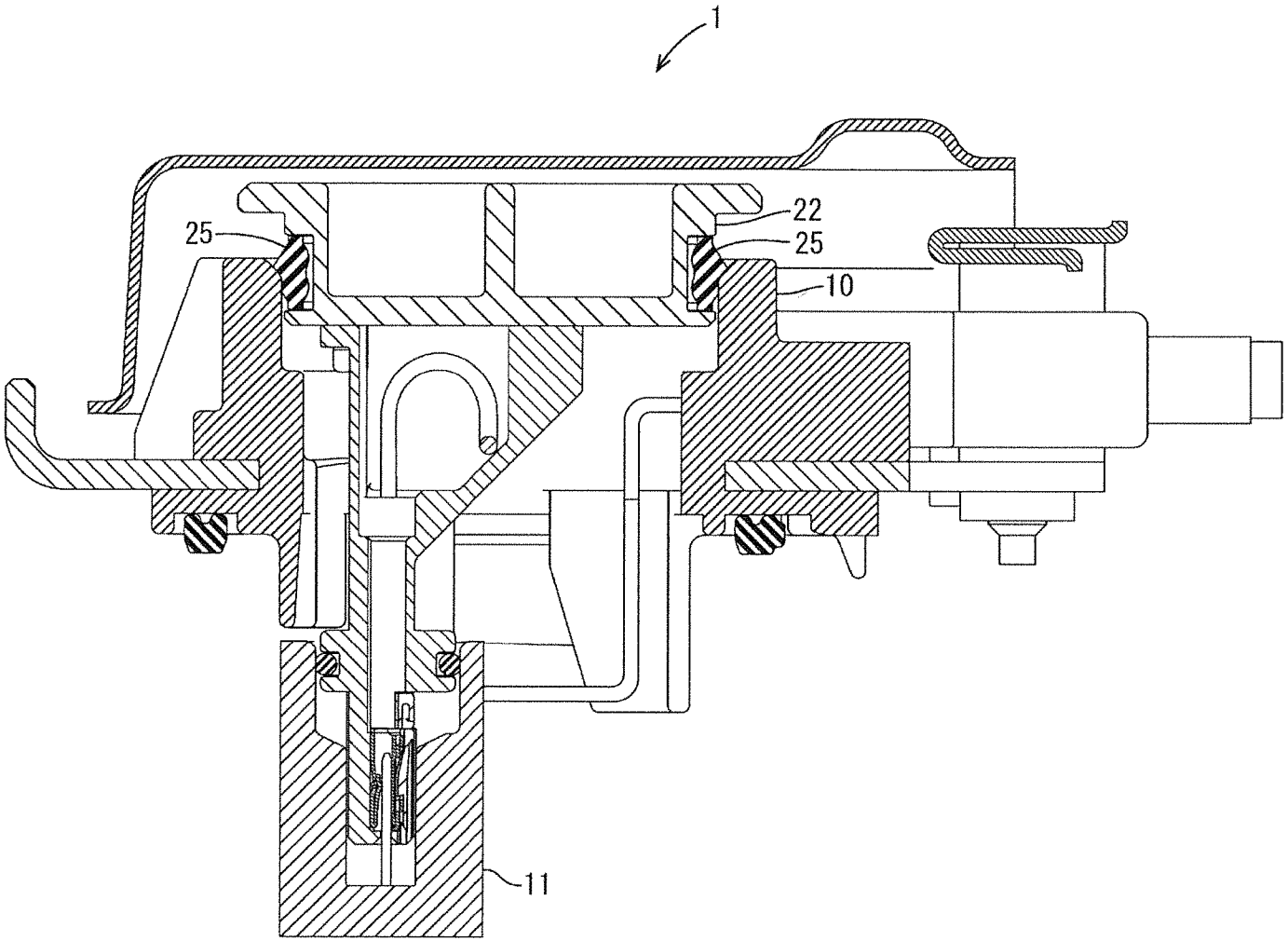
FIG. 8 is a section showing the state of mounting the seal cover.

When the seal cover 1 is pushed farther, as shown in FIG. 8, the fitting 22 is fit and inserted into the opening portion 10 and the shaft seal 25 is pressed by the inner peripheral surface of the opening portion 10 to be compressed. FIG. 8 shows a state at a time point when the shaft seal 25 is compressed maximally, and this time point is referred to as a time point T3 in the following description.

Figure 9:
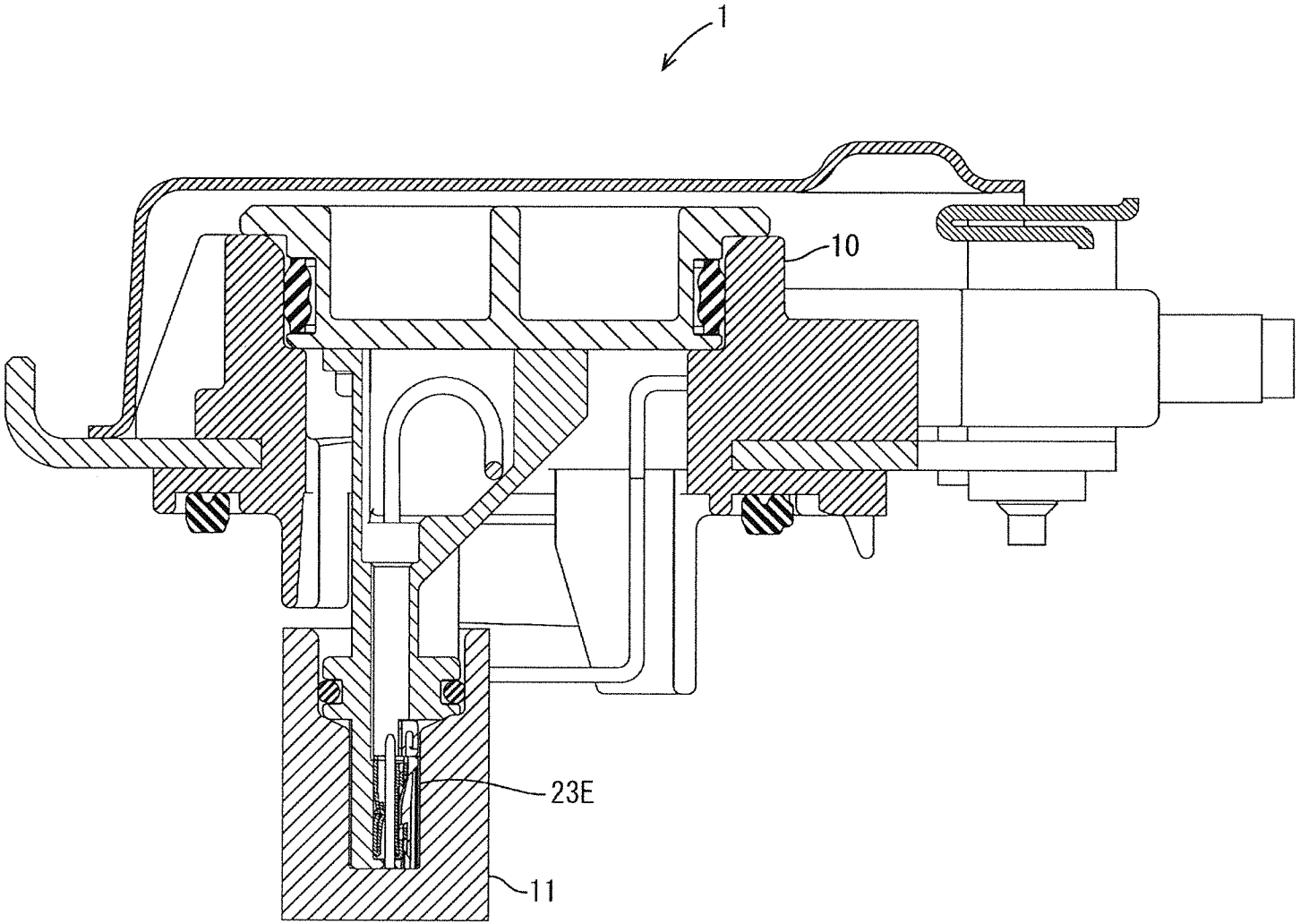
FIG. 9 is a section showing the state of mounting the seal cover.

When the seal cover 1 is pushed completely, as shown in FIG. 9, the squeezing of the ribs 23E is finished. FIG. 9 shows a state at a time point when the seal cover 1 is pushed completely (i.e. time point when the squeezing of the ribs 23 is finished) and this time point is referred to as a time point T4 in the following description. Note that, in this embodiment, the ribs 23E are long in the vertical direction, and some parts of the ribs 23E are left unsqueezed even if the seal cover 1 is pushed completely. Specifically, the ribs 23E are not necessarily squeezed completely when the squeezing thereof is finished.

As just described, in this embodiment, the time point T1 when the female terminals 23B are resiliently deformed maximally, the time point T2 when the O-ring 23D is compressed maximally, the time point T3 when the shaft seal 25 is compressed maximally and the time point T4 when the squeezing of the ribs 23E is finished do not overlap with each other when the seal cover 1 is mounted on the opening portion 10.

Specifically, the ribs 23E, the female terminals 23B, the shaft seal 25 and the O-ring 23D are arranged in such a positional relationship that the time point when the O-ring 23D is compressed maximally, the time point when the female terminals 23B are resiliently deformed maximally, the time point when the shaft seal 25 is compressed maximally and the time point when the squeezing of the ribs 23E is finished do not overlap with each other when the seal cover 1 is mounted on the opening portion 10.

Figure 10:
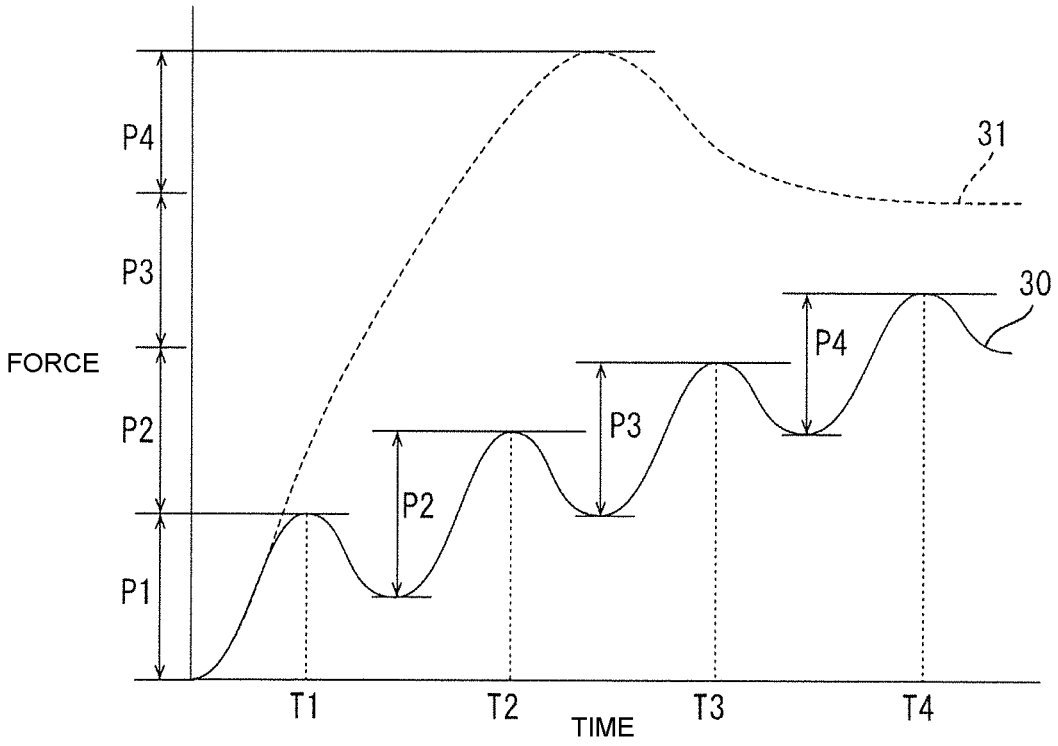
FIG. 10 is a graph showing a change of a force when the seal cover is mounted.

Next, a change of a force when the worker mounts the seal cover 1 is described with reference to FIG. 10. In FIG. 10, a solid line 30 shows a change of a force when the worker mounts the seal cover 1. However, FIG. 10 is for conceptually describing the change of the force when the seal cover 1 is mounted and does not show a result of actual measurement of the force when the seal cover 1 is mounted. Thus, the change of the force when the seal cover 1 actually is mounted does not necessarily match that of FIG. 10.

As shown by the solid line 30, the force when the worker mounts the seal cover 1 temporarily decreases after becoming maximum at the time point T1 when the female terminals 23B are resiliently deformed maximally. The same applies also to the time points T2 to T4. The force when the seal cover 1 is mounted temporarily decreases after becoming maximum at those time points.

For example, it is assumed that P1 denotes a force when the force for mounting the seal cover 1 becomes maximum at the time point T1, P2 denotes a difference between a force temporarily decreased and becoming minimum after the time point T1 and a force becoming maximum at the time point T2, P3 denotes a difference between a force temporarily decreased and becoming minimum after the time point T2 and a force becoming maximum at the time point T3 and P4 denotes a difference between a force temporarily decreased and becoming minimum after the time point T3 and a force becoming maximum at the time point T4.

In the seal cover 1, a force required when the worker mounts the seal cover 1 on the opening portion 10 is maximized when the squeezing of the ribs 23E is finished at the time point T4 and the force at that time is smaller than the sum of P1 to P4.

In contrast, a graph shown by a dotted line 31 in FIG. 10 is a comparative example showing a force required if all of the time point when the female terminals 23B are maximally resiliently deformed, the time point when the O-ring 23D is compressed maximally, the time point when the shaft seal 25 is compressed maximally and the time point when the squeezing of the ribs 23E is finished overlap when the seal cover 1 is mounted on the opening portion 10. As understood from FIG. 10, if these time points overlap, a maximum force required when the worker mounts the seal cover 1 on the opening portion 10 is substantially equal to the sum of P1 to P4.

Specifically, if the four time points described above do not overlap, the maximum force required when the worker mounts the seal cover 1 on the opening portion 10 can be reduced as compared to the case where those time points overlap.

(4) Effects of Embodiment

According to the seal cover 1 relating to the embodiment described above, three time points, i.e. the time point T1 when the female terminals 23B are resiliently deformed maximally, the time point T2 when the O-ring 23D is compressed maximally and the time point T3 when the shaft seal 25 is compressed maximally do not overlap with each other. Thus, the force required when the worker pushes the seal cover 1 can be reduced as compared to the case where at least two, out of three time points, overlap. In this way, a burden of the worker in mounting the seal cover 1 with the interlock connector 23 having the O-ring 23D fit on the outer peripheral surface can be reduced.

Further, according to the seal cover 1, four time points, i.e. the time point T1 when the female terminals 23B are resiliently deformed maximally, the time point T2 when the O-ring 23D is compressed maximally, the time point T3 when the shaft seal 25 is compressed maximally and the time point T4 when the squeezing of the ribs 23E is finished do not overlap with each other. Thus, the burden of the worker can be reduced further.

The invention is not limited to the above described and illustrated embodiment. For example, the following embodiments also are included in the scope disclosed in this specification.

Although a case where the connector housing 23A of the interlock connector 23 is provided with the ribs 23E is described as an example in the above example, the ribs 23E may not necessarily be provided.

Although a case where the female terminals 23B are resiliently deformed maximally, the O-ring 23D is compressed maximally, the shaft seal 25 is compressed maximally and the squeezing of the ribs 23E is finished in this chronological order is described in the above embodiment, the sequence of these time points is not limited to this. A sequence can be determined appropriately.

Although a case where the female terminals 23B, out of the male terminals 11B of the standby connector 11 and the female terminals 23B of the interlock connector 23, are deformed resiliently is described as an example in the above embodiment, the male terminals 11B may be deformed resiliently.

Although a case where the interlock connector 23 is held on the fitting 22 in a floating state is described as an example in the above embodiment, the interlock connector 23 may not be held in a floating state. Specifically, the interlock connector 23 may be held non-displaceably on the fitting 22.

LIST OF REFERENCE SIGNS

1 . . . seal cover
10 . . . opening portion
11 . . . standby connector
11A . . . standby housing
11B . . . male terminal (example of standby terminal),
21 . . . lid
22 . . . fitting
23 . . . interlock connector
23B . . . female terminal (example of detection terminal)
23C . . . step
23D . . . O-ring (example of second ring)
23E . . . rib
25 . . . shaft seal (example of first ring).

The invention claimed is:

1. A seal cover for closing an opening portion provided in a device in which a standby connector is disposed, the standby connector including a standby terminal for switching a state of an energizing circuit between a conductive state and a non-conductive state is disposed, the seal cover comprising:

a lid for covering an opening of the opening portion;

a fitting disposed on a back surface of the lid and configured to be fit into the opening portion, a first ring made of resin and fit on an outer peripheral surface of the fitting, the first ring being disposed and configured to be compressed and held in close contact with an inner peripheral surface of the opening portion and an interlock connector projecting from the fitting, the interlock connector being configured and disposed to be connectable to the standby connector, the interlock connector including a detection terminal to be pressed into contact with the standby terminal, a second ring made of resin being fit on an outer peripheral surface of the interlock connector and being configured and disposed to be compressed and held in close contact with an inner peripheral surface of the standby connector, one of the standby terminal and the detection terminal being resiliently deformed and pressed into contact with the other of the standby terminal and the detection terminal;

the detection terminal, the first ring and the second ring being arranged in such a positional relationship that a time point when the first ring is compressed maximally, a time point when the second ring is compressed maximally and a time point when the one terminal is resiliently deformed maximally do not overlap with each other when the seal cover is mounted on the opening portion.

2. The seal cover of claim 1, further comprising:

an annular step formed on the outer peripheral surface of the interlock connector and protruding over an entire circumference and having the second ring fit thereon and a rib provided on the outer peripheral surface of the interlock connector in front of the step in a connecting direction and to be pressed into contact with the inner peripheral surface of the standby connector and squeezed when the interlock connector is connected to the standby connector; and the detection terminal, the first ring, the second ring and the rib are arranged in such a positional relationship that the time point when the first ring is compressed maximally, the time point when the second ring is compressed maximally, the time point when the one terminal is resiliently deformed maximally and a time point when the squeezing of the rib is finished do not overlap with each other when the seal cover is mounted on the opening portion.

* * * * *